United States Patent [19]

Hashimoto et al.

[11] 4,006,584

[45] Feb. 8, 1977

[54] ELECTRONIC TIMEPIECE

[75] Inventors: Shingo Hashimoto; Yasuhiko Nishikubo; Heihachiro Ebihara; Hiroyuki Fukayama, all of Tokyo, Japan

[73] Assignee: Citizen Watch Co., Ltd., Tokyo, Japan

[22] Filed: May 16, 1975

[21] Appl. No.: 578,071

[30] Foreign Application Priority Data

Nov. 14, 1974 Japan ..... 49-131256

[52] U.S. Cl. ..... 58/23 A; 58/28 R; 331/116 M

[51] Int. Cl.[2] ..... G04C 3/00

[58] Field of Search ..... 58/23 A, 23 TF, 23 R, 58/23 AC, 28 R, 28 A, 28 B, 28 D; 318/119, 122, 126, 127, 133; 331/116 R, 116 M

[56] References Cited

UNITED STATES PATENTS

| | | | |
|---|---|---|---|
| 3,124,731 | 3/1964 | Eysen et al. | 58/28 A X |
| 3,727,151 | 4/1973 | Koehler | 58/23 AC X |
| 3,742,386 | 6/1973 | Gerum | 58/23 A X |
| 3,845,367 | 10/1974 | Keller | 318/127 |
| 3,884,032 | 5/1975 | Kanazawa et al. | 58/28 A X |

*Primary Examiner*—Ulysses Weldon

*Attorney, Agent, or Firm*—Spensley, Horn & Lubitz

[57] ABSTRACT

An electronic timepiece having an electronic circuit which comprises a monolithic integrated circuit including a multistage amplifier. The amplifier of the circuit is so designed that an amplitude control component, which has been considered indispensable in the existing art, is unnecessary in the circuit, whereby various types of electronic timepieces are obtainable in a simple and compact manner by applying the monolithic circuit to different types of oscillator means.

4 Claims, 4 Drawing Figures

ELECTRONIC TIMEPIECE

BACKGROUND OF THE INVENTION

1. Field of the Invention

The present invention relates to electronically controlled timepieces, and more particularly to a circuit whose components are simplified so that they may be easily fabricated in a monolithic integrated circuit.

2. Prior Art

Most electronic circuits used in conventional electronic timepieces require several separate electronic components whose fabrication by monolithic integrated circuit techniques is extremely difficult.

In a typical electronic timepiece as shown in the block diagram of FIG. 1, electric signals from an oscillator means are detected by a mechanical-electrical transducer and, after appropriate control and amplifying functions are performed by an electronic circuit, the modified signals are used to supply energy to sustain the vibration of the oscillator by means of an electromechanical transducer. Thus each component is a link in a closed loop. The signal from the oscillator means is relayed and transformed by suitable means to a time display device.

The electronic circuit shown in FIG. 2 is commonly employed in prior art electronic timepieces of the balance wheel, tuning fork and sound fragment types. A phase sensing coil, Ls, is usually part of the electromechanical transducer. Transistor Qo and circuit elements, C, R, and parasitic capacitance Cx correspond to an amplifying and control circuit, and drive coil, $L_D$, is part of the electromechanical transducer. The oscillator means may be a tuning fork having small permanent magnets on its tines or a balance wheel having appropriately disposed magnetic elements. An electromagnetic flux linkage serves to couple the energy between the oscillator means and the transducers. A major reason why the circuit illustrated in FIG. 2 cannot be converted to a monolithic integrated circuit is due to the difficulty in fabricating the resistor and capacitor elements according to integrated circuit techniques. For example, circuit values required for the balance wheel type are 0.47 $\mu$F for capacitance and 10 megohms for resistance, and for the tuning fork type 0.22 $\mu$F for capacitance and 2.2 megohms for resistance for the circuit illustrated in FIG. 2. The achievement of these capacitance and resistance values using ordinary bipolar fabrication techniques has been considered difficult. However, it has recently been possible (Koehler, U.S. Letters Pat. No. 3,727,151) to fabricate the circuit shown in FIG. 2 according to monolithic integrated circuit techniques for electronic timepieces of the tuning fork type, using the values of $C = 200$ pF, $R = 100$ megohms, and super-gain bipolar transistors having hFE = 5000. While mass fabrication of capacitors in the 200 pF range is feasible, the values of transistor hFE and resistor R profitably attainable for mass fabrication under ordinary bipolar techniques are approximately 1 megohm for resistor R and about 1000 for transistor hFE. Understandably, therefore, the above-mentioned prior art presents a great many problems for mass fabrication that an extremely low yield is obtained and the circuit cannot be put into practical use.

We have, using new fabricating and circuit technologies, previously disclosed a method of fabricating an electronic circuit (shown in FIG. 3) which can be converted to a monolithic integrated circuit device (U.S. Pat. No. 3,905,188). The circuit is divided into three major blocks:

1. a first block, comprising capacitor $C_1$, resistors $R_1 - R_4$, and transistors $Q_1 - Q_3$, which is an amplitude control component of the oscillator and which processes signals from the coil Ls portion of a mechanical-electrical transducer by differentiation with capacitor $C_1$;
2. a second block, comprising resistors $R_5 - R_8$ and transistors $Q_4 - Q_{11}$, which is an amplifier for amplifying signals from the transducer Ls received through capacitor $C_2$; and
3. a third block, comprising resistor $R_9$ and capacitor $C_2$, which is a time constant component to control the resonant frequency of the circuit.

The maximum values employed in this circuit are a resistance of 500 megohms, a capacitance of 2000 pF, and an npn transistor having an hFE in the range of 500. A novel feature of the above invention when compared with conventional bipolar circuits resides in the resistor and capacitor components. The resistor, $R_9$, employs an element (hereinafter referred to as MOS-R) comprising a drain of depletion-type MOS transistor as one terminal, and source, gate and base plate connected in series as the remaining terminal. The capacitor, $C_2$, has a metal-oxide-alumina-oxide silicon structure (hereinafter referred to as MO'AOS), using said metal layer as one terminal and the silicon layer as the remaining terminal. Although a similar capacitance can be obtained from a common MOS formula for the capacitor, i.e., metal-oxide-silicon, the aforementioned MO'AOS formula is more advantageous for fabrication when combined with MOS-R. Even with this fabricating technique, the circuit is still complex as can be seen in FIG. 3.

Consider the operating principle of the device shown in FIG. 2. Normally, transistor Qo will be biased to be approximately at the cut-off point. When a switch is closed and a step voltage from the circuit voltage supply is applied to the node of coil Ls and the RC tank circuit, the voltage across the RC tank circuit will ring about the cut-off point of transistor Qo. The collector current will therefore have an impulse frequency as determined by the RC tank circuit. If the resonant frequency of the collector current or RC tank circuit is matched to the resonant frequency of a mechanical oscillator or a tuning fork, a sympathetic voltage and current may be set up in sensing coil Ls. The voltage induced in coil Ls will reinforce the resonant ringing of the RC tank circuit and a self-sustaining oscillation will be set up. Thus, the time constant of the RC tank circuit must be chosen to match the resonant frequency of the oscillator means. If RC time constant is shorter than the oscillator's resonant value, the base bias will oscillate too fast to drive the collector current at the oscillator's resonant frequency. The oscillator will accordingly be driven at a frequency less than its resonant frequency. The reverse situation can easily be surmised. As a consequence, excessive power may be consumed or the oscillator means may fail to resonate with sufficient amplitude to drive the clock mechanism.

When used in a timepiece of the balance wheel type, the FIG. 2 circuit having ordinary transistor hFE values requires the values of $R = 10$ megohms, $C = 0.47$ $\mu$F, and produces a time constant of 4.7 second; whereas the FIG. 3 circuit without the first circuit block, the amplitude control component, requires the values of $R_9$ = 500 megohms, $C_2$ = 200 pF, and has a time constant of 0.1 second. Thus, the prior art circuit illustrated in FIG. 3, having only the second and third blocks, the amplifier and time constant components, produces resonant oscillation having a shorter period and a higher frequency than the FIG. 2 circuit, making the FIG. 3 circuit unsuitable as a drive circuit for a balance wheel type timepiece. The time constant $R_9C_2$ needs to be an order of magnitude higher. However, the fabrication of a capacitor and resistor having a RC product in the range of 1 to 10 seconds is entirely impractical according to present integrated circuit mass production techniques. However, our prior art circuit, illustrated in FIG. 3, has a low enough effective resonant frequency so as to be successfully coupled to balance wheel oscillators.

A major drawback of the FIG. 3 circuit lies in the amplitude control component, the first block, whose function is to lengthen the time constant of the second and third circuit blocks, i.e. the amplifier and time constant components, in order to make the circuit usable in balance wheel timepieces. The design criteria and tolerances of the circuit portion denoted as the first block in FIG. 3 are very critical and the overall performance of the circuit is extremely sensitive to small variations. Without exception even the most careful mass production processes have obtained very small yields of this circuit and small improvements in yields are difficult to achieve and are obtained only at high cost.

Therefore, what is needed is an integrated circuit amplifier and oscillator which is capable of being combined with a mechanical oscillator, and which is adapted to economical and practical mass production techniques without requiring large resistance, capacitance or transistor hFE values.

BRIEF SUMMARY OF THE INVENTION

Applicants have found that the aforementioned amplitude control component, the first block of the FIG. 3 circuit, can in fact be omitted contrary to the anticipation, when the circuit is applied to a timepiece of the tuning fork type having a tuning fork with a certain resonant frequency. On the basis of this general hint, a simpler timepiece has been developed for practical use.

Accordingly, the primary object of this invention is to provide an electronic circuit for electronically controlled timepieces consisting of a monolithic integrated circuit comprising a multistage amplifier.

Another object of this invention is to provide an electronic circuit for electronic timepieces in which an amplitude control means is unnecessary.

Still another object of this invention is to provide a variety of different types of electronic timepieces applying the circuit to various oscillator means.

The novel features which are considered to be characteristic of the invention are set forth in particular in the appended claims. The invention itself, however, both as to its construction and method of operation, together with additional objects and advantages thereof, will be best understood from the following description of specific embodiments when read in connection with the accompanying drawings.

DETAILED DESCRIPTION OF THE INVENTION

Figure 1:
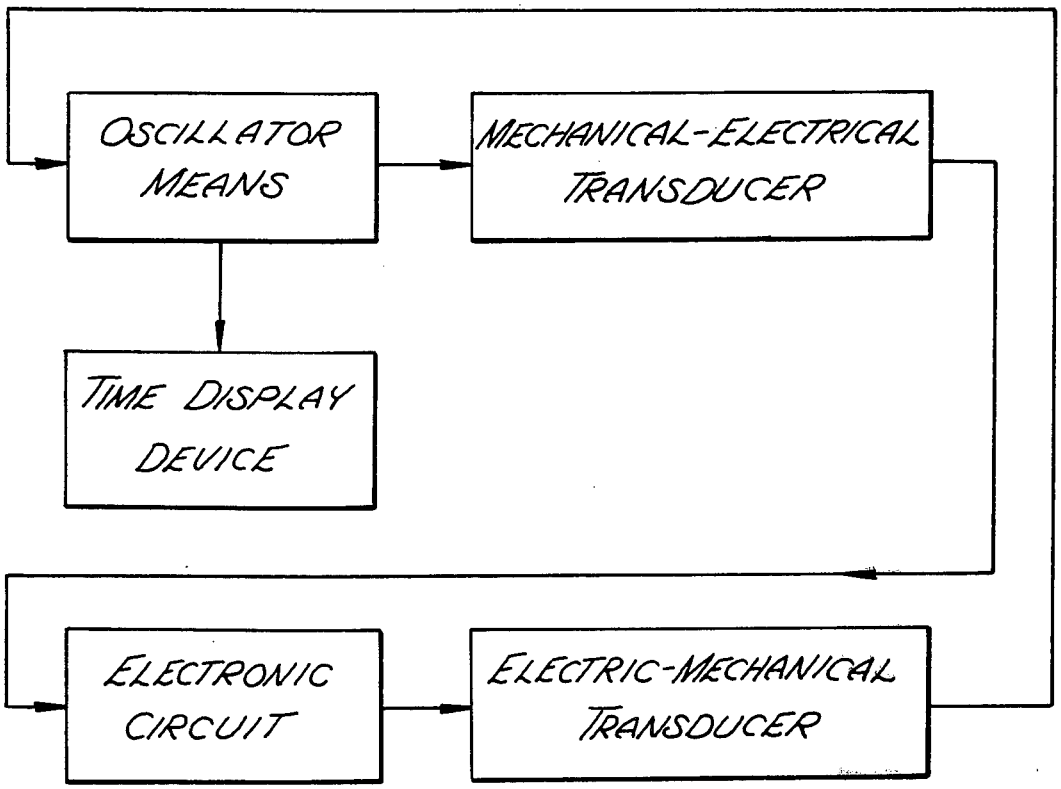
FIG. 1 is a block diagram showing the components of an electronic timepiece.

FIG. 1 shows a general arrangement of an electronic timepiece in the form of a block diagram, where electric signals from an oscillator means are picked up by a mechanical-electrical transducer and after appropriate control and amplifying functions are performed by an electronic circuit, the modified signals are used to supply energy to sustain the vibration of the oscillator means by means of an electro-mechanical transducer.

The electronic circuit of this invention generally comprises a multistage amplifier including feedback resistors, capacitors and active elements as a one-chip monolithic integrated circuit. The resistors may preferably have a two-terminal element, where one terminal of said element is the drain of a MOS transistor of the depletion type and the other terminal of said element is a source, gate and substrate connected in series and the capacitor may have a metal-oxide-alumina-oxide-silicon structure where said metal is one terminal and said silicon is the remaining terminal.

Now referring to FIG. 4 which specifically shows an embodiment of the circuit applicable to the timepiece of this invention, a capacitor $C_{11}$, resistors $R_{11}$, $R_{12}$, $R_{13}$, $R_{14}$, and $R_{15}$, npn bipolar transistors $Q_{21-26}$ and $Q_{28}$, and pnp bipolar transistor $Q_{27}$ are arranged in the following manner. Each terminal of said resistor $R_{11}$, $R_{12}$, $R_{13}$, $R_{14}$ is connected, together with the emitter of bipolar transistor $Q_{27}$ to a positive voltage terminal of a power source, while the remaining terminal of said resistors is arranged such that $R_{11}$ connects to collectors of transistors $Q_{21}$ and $Q_{22}$ and base of transistor $Q_{23}$, $R_{12}$ connects to collectors of transistors $Q_{23}$ and $Q_{24}$ and the base of transistor $Q_{25}$, $R_{13}$ connects to the collector of transistor $Q_{25}$, and $R_{14}$ connects to the collector of transistor $Q_{26}$ and the base of transistor $Q_{27}$. The emitters of the transistors are arranged such that the emitter of transistor $Q_{21}$ connects to the base of transistor $Q_{22}$, the emitter of transistor $Q_{23}$ connects to the base of transistor $Q_{24}$, the emitter of transistor $Q_{25}$ connects to the base of transistor $Q_{26}$, and the collector of transistor $Q_{27}$ connects to the base of transistor $Q_{28}$, and emitters of transistors $Q_{22}$, $Q_{24}$, $Q_{26}$ and $Q_{28}$ connect to the minus voltage terminal of the power source. Each terminal of resistor $R_{15}$ and capacitor $C_{11}$ is connected to the base of transistor $Q_{21}$, and the remaining terminal of said resistor $R_{15}$ is connected to the collector of transistor $Q_{28}$, while the remaining terminal of said capacitor $C_{11}$ is connected to said mechanical-electrical transducer, and one terminal obtained by joining said resistor $R_{15}$ and collector of transistor $Q_{28}$ is connected to said electro-mechanical transducer.

Figure 2:
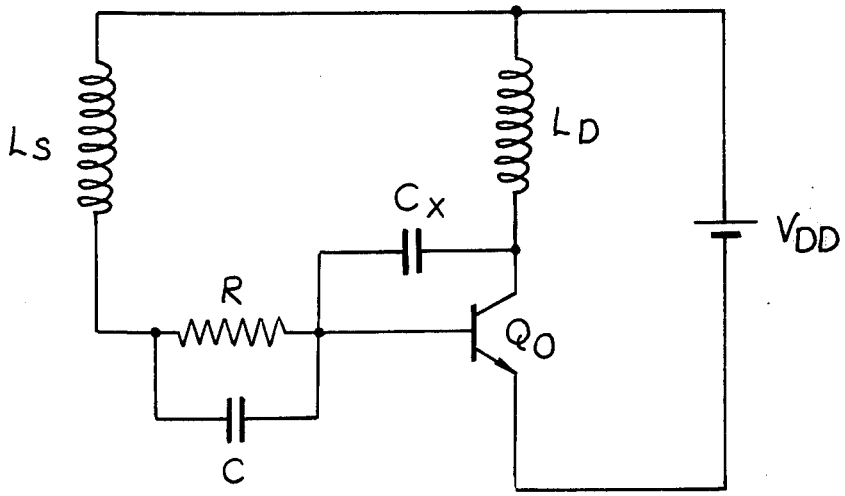
Fig. 2 PRIOR ART
FIG. 2 illustrates an example of a commonly known drive circuit for an electronic timepiece.
Figure 3:
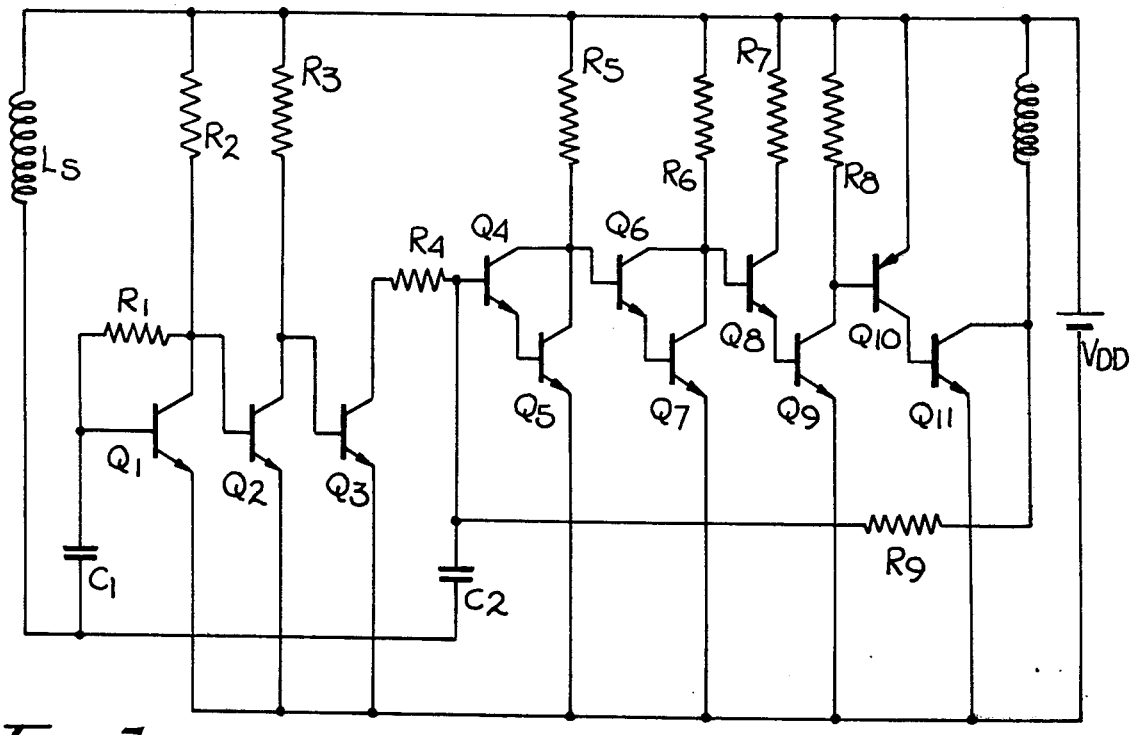
Fig. 3 PRIOR ART
FIG. 3 shows a prior art monolithic integrated circuit.
Figure 4:
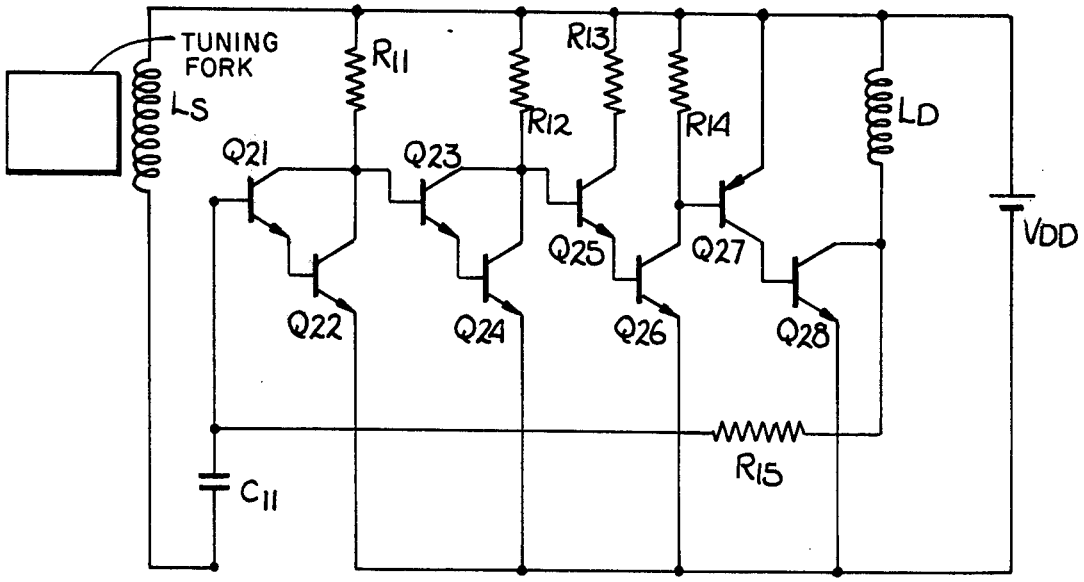
FIG. 4 shows an embodiment of the monolithic integrated circuit of the timepiece of this invention.

As compared with the prior art circuit shown in FIG. 3, the first block, the amplitude control component, is omitted in the FIG. 4 circuit. In the operation, if $R_{15}$ = 50 megohms, and $C_{11}$ = 150 pF, the circuit of FIG. 4 has a time constant of $7.5 \times 10^{-8}$ sec.; and if R = 2.2 megohms, C = 0.22 $\mu$F, the circuit of FIG. 2 has a time constant of RC = $4.84 \times 10^{-1}$ sec. (One reason for this is that the amplifier characteristics will change when more than one transistor is used. For example, since the circuit of FIG. 4 requires twice as much base bias as the circuit of FIG. 2, this fact alone increases the time constant by two.) In addition, a greater difference in input impedance is expected because the gain in the circuit of FIG. 4 is much greater than that in the circuit of FIG. 2. Another reason resides with the mechanical tuning fork oscillator in which the Q value of the resonance is considerably greater than that in a balance wheel oscillator. In other words, the circuit of FIG. 4 tends to be pulled into resonance at the resonant frequency of the mechanical tuning fork and therefore is much more stable than when used in combination with a balance wheel oscillator. This is why it is possible to omit the amplitude control component from the circuit illustrated in FIG. 3 and simplify it to a circuit having only the amplifier and time constant components as shown in FIG. 4, by modifying the circuit according to resonant frequency and resonance Q values of the tuning fork oscillator.

The amplifier component of the FIG. 4 circuit is essentially of an input-output phase inverter amplifier, which is capable of large gains through a multi-stage inverter, rather than through a single transistor which is incapable of obtaining sufficiently large gains. In the preferred embodiment, an input-output phase inverter amplifier is used as shown in FIG. 4, since the output of the mechanical-electrical transducer and the input of the electro-mechanical transducer in a tuning fork driven timepieces are of the phase-inverter type. However, the circuit should be designed accordingly if the mechanical oscillator calls for a non-inverting type of amplifier.

As discussed above, a drive circuit using a circuit comprising a multi-stage amplifier component and a time constant component which are modified to match the resonant frequency, Q value of a tuning fork allows one to fabricate a monolithic integrated circuit of fewer components and having higher yields.

While there have been shown and described a preferred embodiment of a monolithic integrated circuit for an electronic timepiece of the tuning fork type, application to timepieces of the balance wheel type, the sound fragment type and the like with oscillators having high resonance frequencies and high Q values is possible by making modifications and changes which are obvious to one with ordinary skill in the art without departing from the essential spirit of the present invention.

We claim:

1. An electronic timepiece comprising:

an oscillator of high frequency and substantially stable amplitude;

a mechanical-electrical transducer for picking up signals from the oscillator;

an electronic circuit for amplifying signals from said mechanical-electrical transducer;

an electromechanical transducer for supplying the signals to the oscillator at a vibrations-sustaining energy;

a time display device coupled to said oscillator;

said oscillator, said mechanical-electrical transducer, said electronic circuit and said electromechanical transducer forming a closed loop, said electronic circuit, comprising:

a capacitor; resistors $R_{11}$, $R_{12}$, $R_{13}$, $R_{14}$ and $R_{15}$; npn bipolar transistors $Q_{21}$, $Q_{22}$, $Q_{23}$, $Q_{24}$, $Q_{25}$ and $Q_{26}$; and $Q_{28}$ pnp bipolar transistor $Q_{27}$;

each terminal of said resistor $R_{11}$, $R_{12}$, $R_{13}$, $R_{14}$ is connected, together with the emitter of bipolar transistor $Q_7$, to a positive voltage terminal of a power source;

in the remaining terminal of said resistors:

$R_{11}$ connects to collectors of transistors $Q_{21}$ and $Q_{22}$ and base of transistor $Q_{23}$, $R_{12}$ connects to collectors of transistors $Q_{23}$ and $Q_{24}$ and the base of transistor $Q_{25}$, $R_{13}$ connects to the collector of transistor $Q_{25}$, $R_{14}$ connects to the collector of transistor $Q_{26}$ and the base of transistor $Q_{27}$;

the emitter of transistor $Q_{21}$ connects to the base of transistor $Q_{22}$, the emitter of transistor $Q_{23}$ connects to the base of transistor $Q_{24}$, the emitter of transistor $Q_{25}$ connects to the base of transistor $Q_{26}$, the collector of transistor $Q_{27}$ connects to the base of transistor $Q_{28}$;

emitters of transistors $Q_{22}$, $Q_{24}$, $Q_{26}$ and $Q_{28}$ connect to the minus voltage terminal of the power source;

one terminal of resistor $R_{15}$ and capacitor $C_{11}$ is connected to the base of transistor $Q_{21}$;

the remaining terminal of said resistor $R_{19}$ is connected to the collector of transistor $Q_{28}$;

the remaining terminal of said capacitor $C_{11}$ is connected to said mechanical-electrical transducer; and one terminal obtained by joining said resistor $R_{19}$ and collector of transistor $Q_{28}$ is connected to said electro-mechanical transducer.

2. The electronic timepiece according to claim 1, wherein said resistor comprises drain of MOS transistor of the depletion type as one terminal; source, gate and substrate connected in series as the remaining terminal; and said capacitor is fabricated with metal-oxide-alumina-oxide-silicon, said metal layer is one terminal, and said silicon layer is the remaining terminal.

3. The electronic timepiece according to claim 1, wherein said oscillator is a tuning fork.

4. The electronic timepiece according to claim 2, wherein said oscillator is a tuning fork.

* * * * *